US008620013B2

(12) United States Patent
Roeck

(10) Patent No.: US 8,620,013 B2
(45) Date of Patent: Dec. 31, 2013

(54) COMMUNICATION SYSTEM AND HEARING DEVICE

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 929 days.

(21) Appl. No.: 12/761,788

(22) Filed: Apr. 16, 2010

(65) Prior Publication Data

US 2010/0202638 A1 Aug. 12, 2010

Related U.S. Application Data

(63) Continuation of application No. 11/168,704, filed on Jun. 28, 2005, now abandoned.

(30) Foreign Application Priority Data

Jun. 27, 2005 (EP) ..... 05013793

(51) Int. Cl.
*H04R 25/00* (2006.01)

(52) U.S. Cl.
USPC ..... 381/312; 381/311; 381/315; 379/443

(58) Field of Classification Search
USPC ..... 381/315, 23.1, 71.6, 60, 314, 316, 320, 381/321, 331; 379/430, 443
See application file for complete search history.

(56) References Cited

U.S. PATENT DOCUMENTS

| | | | | |
|---|---|---|---|---|
| 5,142,700 | A * | 8/1992 | Reed | 455/344 |
| 5,966,639 | A | 10/1999 | Goldberg et al. | |
| 7,039,195 | B1 | 5/2006 | Svean et al. | |
| 2002/0196955 | A1 | 12/2002 | Boesen et al. | |
| 2003/0045283 | A1 | 3/2003 | Hagedoorn | |
| 2005/0069161 | A1 | 3/2005 | Kaltenbach et al. | |

FOREIGN PATENT DOCUMENTS

| | | | |
|---|---|---|---|
| JP | 2004-274677 | A | 9/2004 |
| WO | 0154458 | A2 | 7/2001 |
| WO | 2004110099 | A2 | 12/2004 |

OTHER PUBLICATIONS

International Search Report for PCT/EP2006/063540 dated Nov. 7, 2006.

* cited by examiner

*Primary Examiner* — Davetta W Goins
*Assistant Examiner* — Amir Etesam
(74) *Attorney, Agent, or Firm* — Pearne & Gordon LLP

(57) ABSTRACT

A communication system has a wireless transmitter and a wireless receiver. The transmitter is built into a hearing device to be worn at one or both ears of an individual. The hearing device has an input acoustical-to-electrical converter unit and an output electrical-to-mechanical converter unit. The wireless transmitter is operationally connectable to the output of the input converter unit. The receiver is remote from the hearing device by a distance larger than any distance between two areas at one single individual. The transmitter and receiver form a wireless communication link at least for audio representing signals.

17 Claims, 10 Drawing Sheets

COMMUNICATION SYSTEM AND HEARING DEVICE

DEFINITIONS

Figure 1:
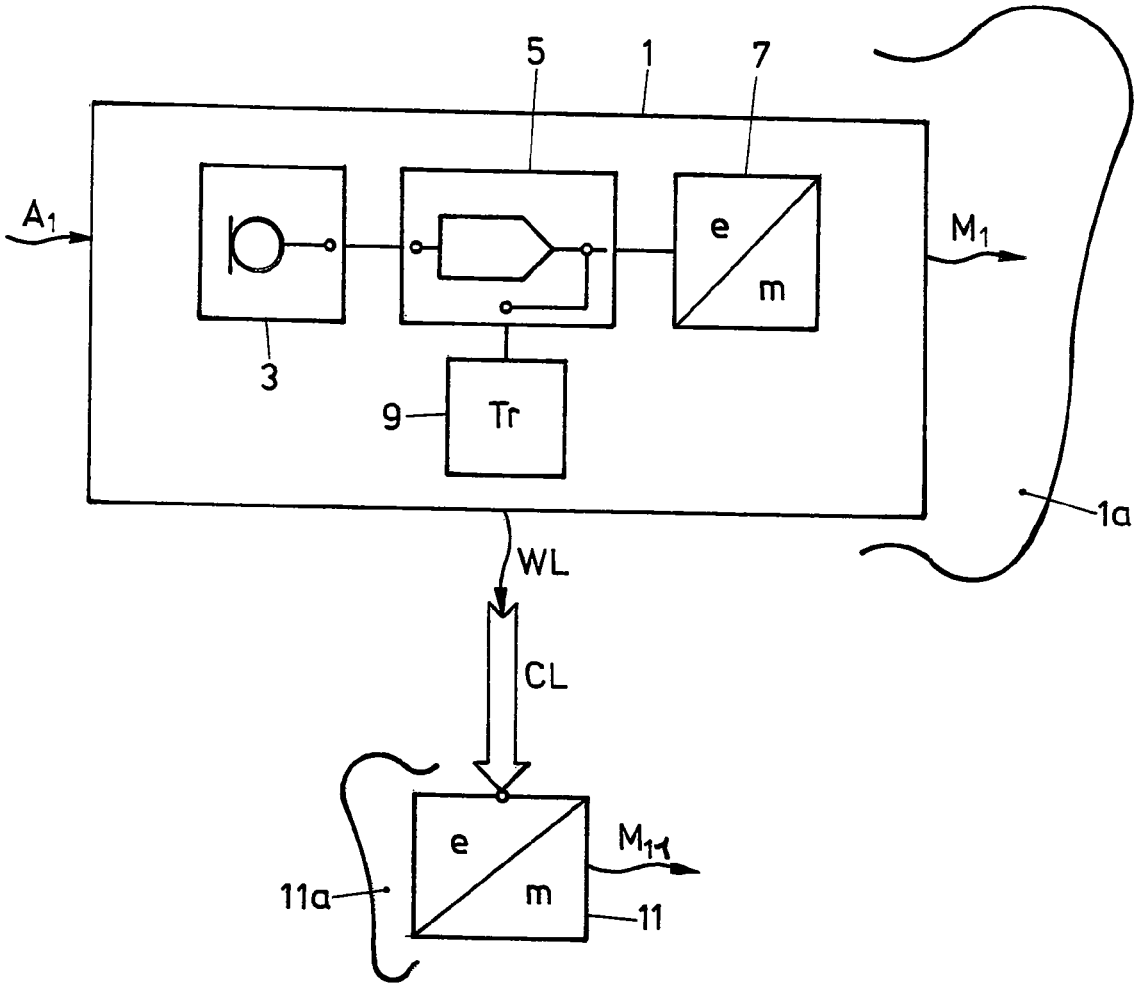

Throughout the present description and claims we understand under the term "hearing device" a device which may be worn by an individual at one or at both ears. The hearing device comprises at least one acoustical-to-electrical converter unit. Such a unit is customarily formed by a microphone unit. If the hearing device is conceived to be worn at both ears of an individual and an acoustical-to-electrical converter unit is provided at each part of the hearing device worn at the respective ears and further there is established a short range communication link between these two parts of the hearing device, then a hearing device is a binaural hearing device in its most general sense. The hearing device has further at least one signal processing unit the input thereof being operationally connected or at least operationally connectable to the output of the input acoustical-to-electrical converter unit. Again if the hearing device is to be worn at both ears of an individual, signal processing units may be provided at both parts of the hearing device at respective ears.

Further the hearing device has at least one electrical-to-mechanical output converter the input of which being operationally connected or operationally connectable to the output of the input acoustical-to-electrical converter.

Again if the hearing device is conceived to be worn at both ears of an individual such electrical-to-mechanical converter may be provided at one or at both parts. Such electrical-to-mechanical converter may e.g. be a loudspeaker unit or a coupling member for mechanically stimulating a part of an individual's inner ear.

Such hearing device may be a device just for improving or facilitating hearing ability of a not hearing impaired individual e.g. in acoustical surroundings which may render perception of specific acoustical signals difficult or may be devices for the protection of an individual's ear from excessive acoustical stimuli etc. or may be hearing aid devices by which for hearing impaired individuals normal hearing is re-established as far as possible.

Hearing devices may be or comprise parts to be worn by an individual outside the ear, inside the ear and thereby also completely in the ear channel.

We understand under a "listening device" a device which comprises an output electrical-to-mechanical converter unit for stimulating hearing of one or more than one individuals. A listening device may thereby be just a loudspeaker unit whereby, as outlined above, a hearing device too is a specific type of such listening device.

We understand under an "audio representing signal" an electrical signal which has been generated by converting and possibly further signal treating e.g. comprising filtering, amplifying etc. departing from an acoustical signal. When a signal is established to be an "at least audio signal representing signal" this means that such signal may additionally comprise program data and/or control data etc., i.e. other types of signal content.

We understand under a "signal booster unit" a unit which receives an input signal and generates and outputs an output signal which is the improved input signal, improved e.g. with respect to signal-to-noise ratio, to frequency content, to power, etc.

We understand under a "router unit" a unit which receives an input signal and outputs at least two output signals which are equal to the input signal. Such router unit may comprise one or more than one signal booster units so as to improve the signals as output with respect to the input signal.

We understand by one point being "connectable" to a second point that such connection between the two points is one possibility out of more than one possibility. Thus additionally to the option of connecting these two points they may be possibly disconnected and one point or both points may be connected to a third point etc. The skilled artisan perfectly knows control and switching ability to establish such "connectability".

The present invention is directed to a communication system as well as to a hearing device.

It is an object of the present invention to widen the scope of use of hearing devices.

This object is achieved by a communication system according to the present invention, which comprises a wireless transmitter and a wireless receiver whereby the transmitter is built into a hearing device to be worn at one or at both ears of an individual. Thereby the hearing device has an input acoustical-to-electrical converter unit and an output electrical-to-mechanical converter unit, as well as a signal processing unit, operationally interconnected between the acoustical-to-electrical and the electrical-to-mechanical converter and processing audio representing signals. The wireless transmitter is operationally connectable to the output of the input converter unit. The communication system further has a receiver which is remote from the hearing device by a distance which is larger than any distance between two areas at one single individual.

The transmitter and the receiver form commonly a wireless communication link at least for audio representing signals.

Establishing a wireless communication link from a remote transmitter to a hearing device comprising a receiver and performing communication in a wireless manner is known e.g. from the DE 100 300 915 according to which such communication is established by using Bluetooth technology.

In opposition, the present invention resides on the fact of establishing a wireless communication departing from a hearing device as worn by an individual towards receiver unit remote from such individual, thereby transmitting via such wireless link audio representing signals. By such a communication system and as will be evident from the following description and claims a very wide range of new uses for hearing devices is opened thereby also improving hearing ability of one or more than one individual.

In an embodiment of the communication system according to the present invention the receiver which is, as was addressed, farer remote from the hearing device with the integrated transmitter than to be possibly worn by the same individual wearing the hearing device, has a wire output and is a part of a further communication link for the addressed at least audio representing signals. Thus downstream the remote receiver a wire communication link is established to further transmit the at least audio representing signal, possibly accordingly processed, which was received by the receiver and from the hearing device integrated transmitter.

In a further embodiment of the present invention the wireless communication link which is established between the hearing device and the addressed remote receiver is only a part of further communication link which additionally has at least one of a further wireless communication link and of a wire bound communication link respectively for the at least audio representing signal. Thus the wireless communication link between the hearing device integrated transmitter and the remote receiver is here only part of a wider communication network which may comprise additional links of wireless and/or wire bound type.

In an embodiment of the present invention the addressed remote receiver has an output which is operationally connectable to an input of an electrical-to-mechanical converter. Thus in this embodiment audio representing signals which are transmitted over the wireless communication link, between hearing device integrated transmitter and remote receiver, are, possibly via additional wireless and/or wire bound communication links and possibly differently processed according to the respective communication links, finally communicated to an electrical-to-mechanical converter unit whereat they are reconverted in hearing stimulating signals for one or more than one individuals, exposed to such mechanical signals. The electrical-to-mechanical converter unit addressed may thereby be a loudspeaker unit for a group of individuals or may be as will be addressed later an electrical-to-mechanical converter unit as customarily integrated into hearing devices. Thus it becomes already yet apparent to the skilled artisan that within the frame of the present invention a hearing device to hearing device communication system becomes possible whereby such communication system is wireless at least at one of the participating hearing devices.

Consequently in one embodiment of the present invention the just addressed electrical-to-mechanical converter unit the input of which being operationally connectable to the output of the remote receiver, forming together with the hearing device integrated transmitter the addressed wireless communication link, is built or integrated into a further hearing device which is to be worn at one or at both ears of a second individual. Thereby the further hearing device has again an input acoustical-to-electrical converter unit and the addressed electrical-to-mechanical converter unit, the input of which being operationally connectable to the output of the addressed remote receiver, being in fact the output electrical-to-mechanical converter unit of the further hearing device.

Thus, as was already addressed, the hearing device with the integrated transmitter may wirelessly communicate via the remote receiver with an output electrical-to-mechanical converter unit of a further hearing device to be worn by a second individual. Thereby such second individual wearing the second hearing device may be arbitrarily remote from the individual wearing the hearing device with the integrated transmitter. The further individual may thus be in the same room as the first individual wearing the hearing device with the integrated transmitter, may be in a neighbouring room or may be at any other remote distance world-wide and distant from the said first individual.

In an embodiment of the communication system as was just addressed, the remote receiver which forms, together with the hearing device integrated transmitter, a wireless communication link, is itself integrated into the further hearing device. Thereby wireless communication from transmitter to receiver is established directly between at least two hearing devices.

As was addressed above the wireless link from hearing device integrated transmitter and remote receiver may only be a part of a further communication link which may include a wide area communication system—WAN—, a local area communication system—LAN—, a signal booster unit, a router unit, etc.

In an embodiment of the communication system as of the present invention the wireless communication link between hearing device integrated transmitter and the addressed remote receiver is performed by frequency modulation (FM) thereby including any known and suitable type of such FM modulation in its most generic meaning, or by any digital modulation scheme such as phase shift keying (PSK), Q-ary amplitude modulation (QAM), ect, or is established making use of ultra-wide-band technology (UWB). Thereby an appropriately long communication range, small transmitters and possibly receivers, small power consumption and small transmitted electro-magnetic powers may be realized which latter is to be considered in context with possible harm of electro-magnetic fields to individuals exposed thereto.

Still in a further embodiment of the communication system according to the present invention both hearing devices which were formerly addressed have respectively a receiver and a transmitter integrated. The one hearing device to be worn at one or at both ears of the one individual, has, additionally to the transmitter, a wireless receiver with an output which is operationally connected to the input of the electrical-to-mechanical converter unit of this one hearing device. The further hearing device to be worn at one or both ears of a second individual has a wireless transmitter—additionally to a receiver—which is connectable to the output of the input acoustical-to-electrical converter unit of this further hearing device. The wireless transmitter at this further hearing device and the wireless receiver at the one hearing device allow a communication link to be established for at least audio representing signals, from said transmitter of the further hearing device to the receiver of the one hearing device. Thus by both addressed hearing devices having a transmitter as well as a receiver a bi-directional communication becomes possible for the addressed at least audio representing signals.

In a further embodiment of the communication system according to the present invention and conceived as was just discussed the output of the acoustical-to-electrical converter unit of the one and of the at least one further hearing devices are operationally connected to inputs of a computing unit. The computing unit generates in dependency from signals which are input to the addressed inputs of the computing unit, at least one computing results at least audio representing signals at an output. The output of a computing unit is operationally connected to the input of at least one of the wireless receivers which are provided at the one and the at least one further hearing devices. Further, the output of this addressed at least one wireless receiver is operationally connected to the input of the output electrical-to-mechanical converter of at least one of the one and of the further hearing devices.

Thus computing unit receives from at least two hearing devices respectively perceived audio representing signals. From these at least two input signals a result audio representing signals is computed. This result audio representing signal is retransmitted to at least one, possibly to both hearing devices so that at least one, possibly both hearing devices transmit to the respective individuals, via their respective electrical-to-mechanical output converter unit, a signal which results from computing acoustical signals perceived at both or at least two hearing devices. Clearly the retransmitted audio representing signal will be an improved signal with an improvement which results from computing commonly both input signals to the computing unit.

In the just addressed embodiment the output of the addressed acoustical-to-electrical converters are operationally connected to the inputs of the computing unit. In one embodiment this is performed in that at least one of the addressed operational connections comprises the wireless transmitter of the respective hearing device.

With an eye on a further embodiment of the communication system according to the present invention, which incorporates the just addressed computing unit, the computing unit performs a selection between the signals which are applied to its inputs and according to at least one selection criterion. Such selection criterion may e.g. be signal-to-noise ratio. The computing unit thereby generates at its output an output signal which accords to one of the input signals as selected. The computing unit further controls at least one of the electrical-to-mechanical output converter units, provided at the one and the further hearing devices to be operationally connected to the output of the computing unit. Thus once the computing unit has selected, out of the input signals a "best-suited" signal, it is this best suited signal which is retransmitted to one or both or all hearing devices participating in the communication system.

In a further embodiment of the communication system according to the present invention and following up the embodiment just discussed, the computing unit performs signal selection dynamically in time. This means that whenever the input signals change the selection of the "best-suited" signal may change as well. Analogically dynamic selection may be performed upon variation in time of the selection criterion. Thus during a first time span signal-to-noise ratio may be selection criterion whereas in a second time span e.g. loudness of acoustical signals may be the selection criterion.

In a still further embodiment of the communication system according to the present invention and still departing from an embodiment with the computing unit as was addressed above, the computing unit may generate an output signal which is not a selection between the input signals as was just discussed, but which is an audio representing signal depending on both input signals. Thereby generically the information increase which is achieved by evaluating two or more audio representing signals is exploited so as to generate a combined signal which is improved relative to each input signals considered per se.

Thus the computing unit may e.g. be conceived to perform beam forming. Exploiting input signals which in fact come from remotely located hearing devices, which are mutually distant far more than multiple microphones might be distant in a single hearing device, leads to improved possibilities of beam forming.

As the communication system according to the present invention making use of the computing unit clearly may incorporate more than two hearing devices with their respective acoustical-to-electrical converters, it becomes clear that computation may be performed with respect to the output signals of more than two of these acoustical-to-electrical converter units, which further largely increases the possibilities of improved signal processing.

In a still further embodiment of the communication system according to the present invention communication from one hearing device to a remote further hearing device may be performed in a manner hopping from one hearing device to the next in a chain of hearing devices. Each of the intermediate devices forms a signal booster unit, possibly without the respective individual becoming aware that its hearing device is being used as signal booster unit.

To do so the system comprises more than two hearing devices. A transmitter of a first hearing device is operationally connected to the output of its input acoustical-to-electrical converter unit. The output of the addressed transmitter is operationally linked by the wireless link to the receiver of the second hearing device. The output of this receiver is operationally connected to the input of the transmitter at the same hearing device so that in fact the signal received by the receiver is looped to that transmitter. The output of the transmitter of the just addressed hearing device is operationally linked, including wireless communication, to the receiver of a third hearing device. Thus transmission hopping from one hearing device to the next available one is exploited to bridge a large distance from one hearing device to a remote or far remote target hearing device.

With an eye on the communication system according to the present invention incorporating two hearing devices, in a further embodiment more than two hearing devices participate in such communication system. In a further embodiment of the communication system according to the present invention the one or at least one of the hearing devices is a hearing aid device.

In a further embodiment the one or the two or more than two hearing devices is or are outside the ear hearing devices and/or in the ear hearing devices and/or completely in the ear canal hearing devices. A multiple hearing device communication system may incorporate all the variety of different types of hearing devices, thus e.g. hearing devices for normal hearing individuals, hearing aid devices, binaural hearing devices, provided as outside the ear and/or as in the ear and/or as completely in the ear canal device types.

Under a further aspect of the present invention it is proposed a hearing device to be worn by an individual at one or at both of its ears which comprises an input acoustical-to-electrical converter units/an output electrical-to-mechanical converter unit and a wireless transmitter. The input of the wireless transmitter is operationally connectable to the output of the input acoustical/mechanical converter unit whereby the transmitter generates a wirelessly transmitted signal for a transmission range of at least 2 m. Thus this hearing device allows reception of signals from the wireless transmitter in a range of at least 2 m which is normally significantly larger than the range between devices worn at one individual's body as e.g. binaural devices.

In a further embodiment of the hearing device according to the present invention it comprises a wireless receiver. The output of such receiver is operationally connected to the input of the output electrical-to-mechanical converter unit. In a still further embodiment of the present invention the transmitter generates transmitted signals using carrier-based analog or digital modulation schemes such as frequency modulation (FM), phase modulation (e.g. PSK) or amplitude modulation (e.g. QAM) or based on carrierless ultra-wide band techniques, (UWB) employing e.g. on/off keying (OOK), pulse position modulation (PPM) or pulse amplitude modulation (PAM).

Figure 2:
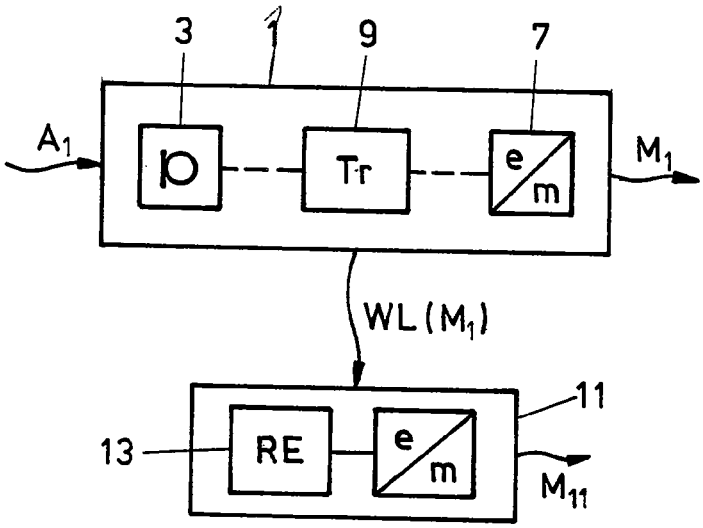
Figure 3:
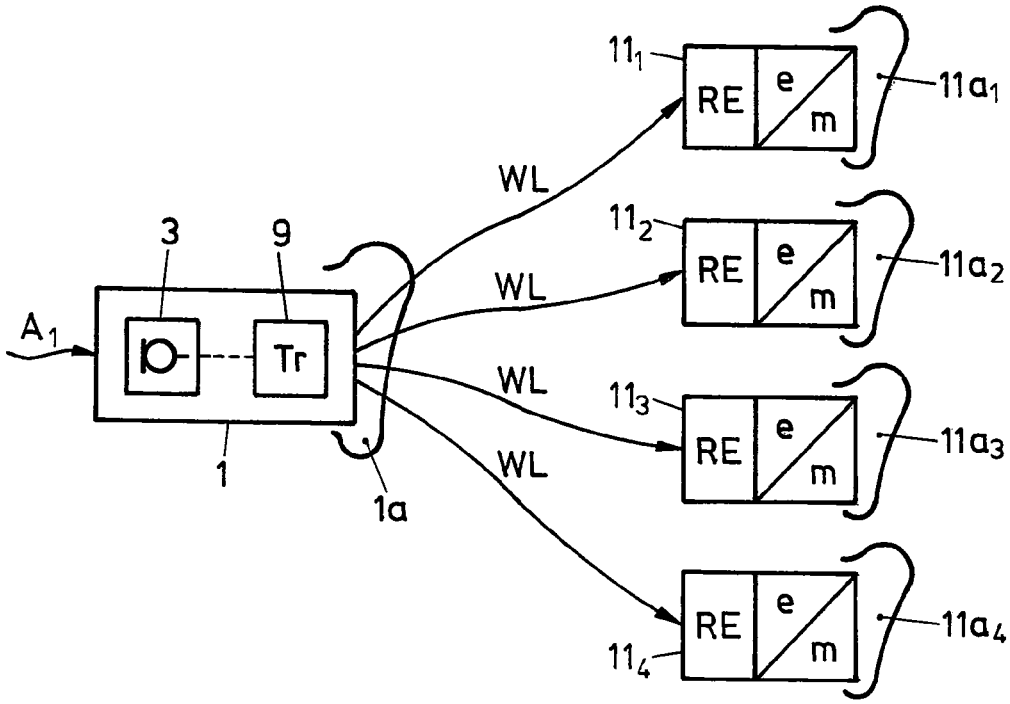
Figure 4:
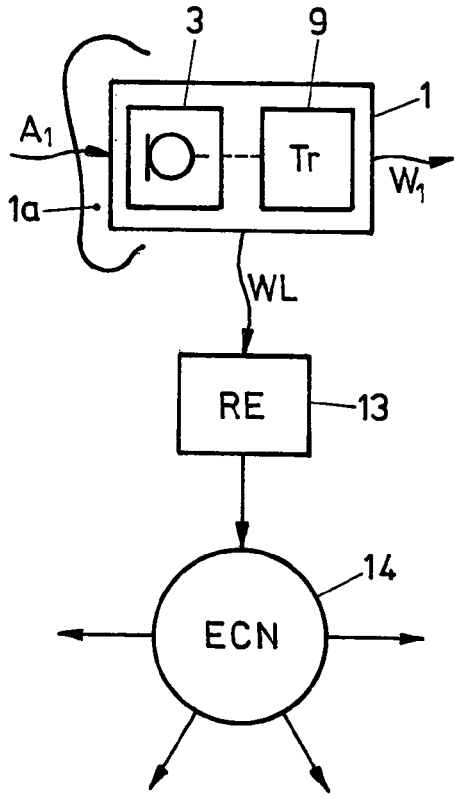
Figure 5:
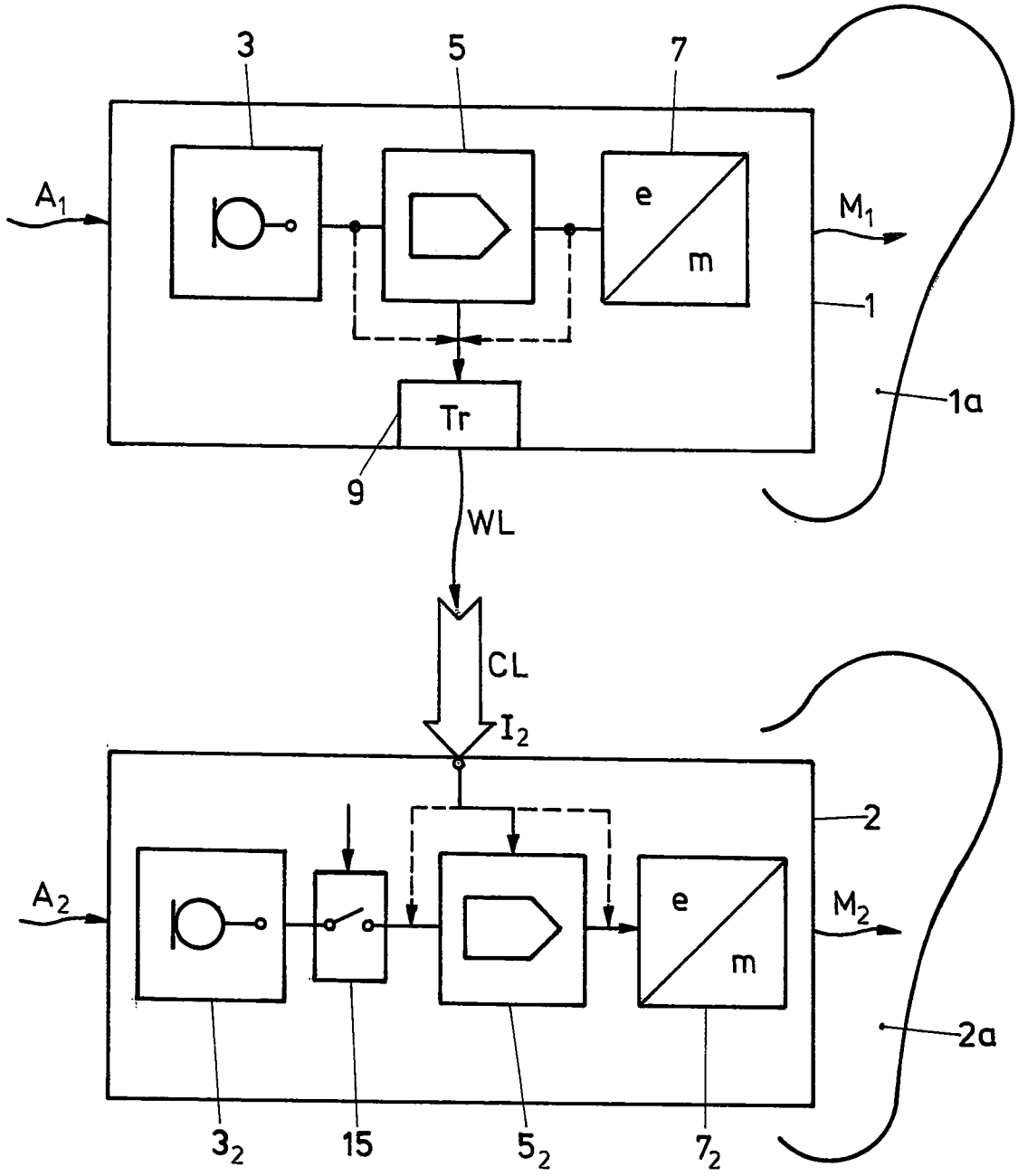
Figure 6:
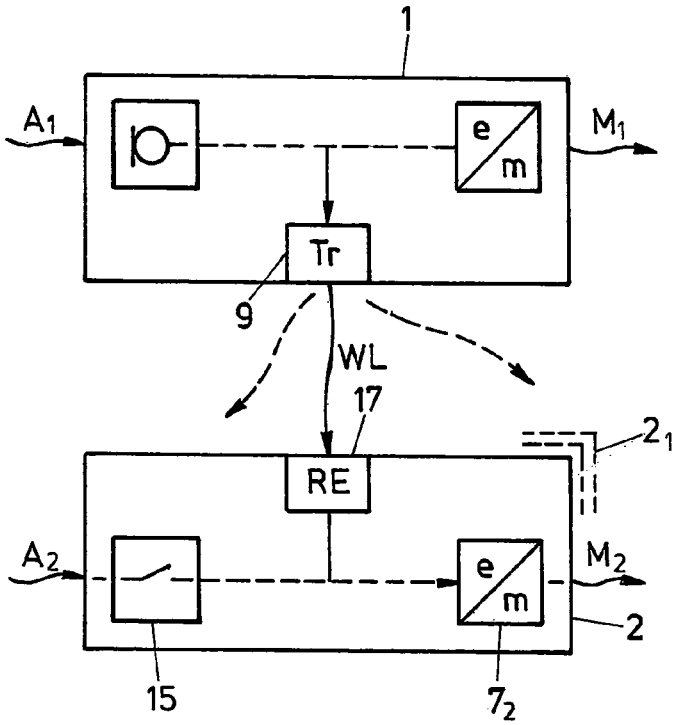
Figure 7:
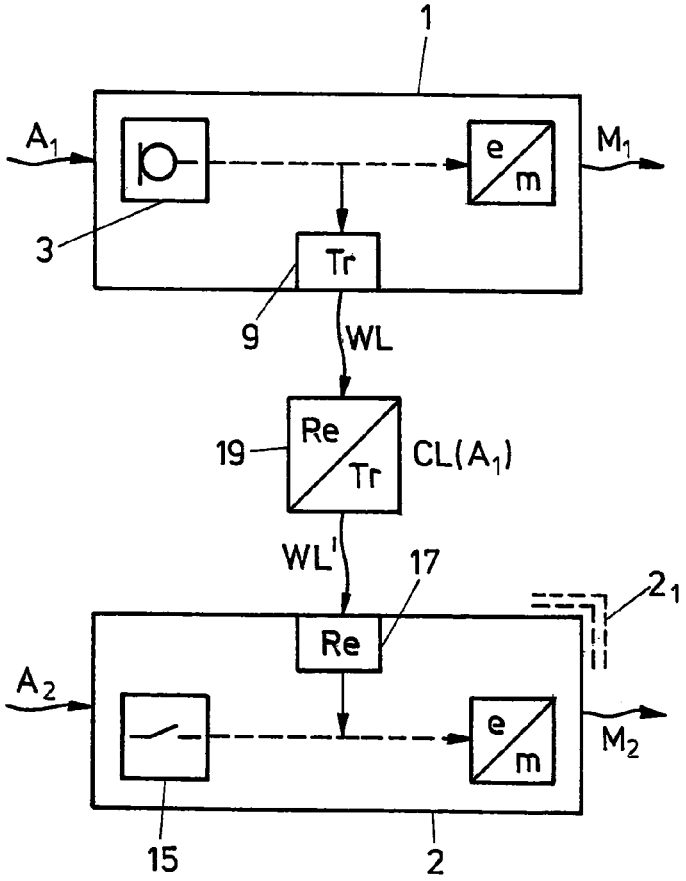
Figure 8:
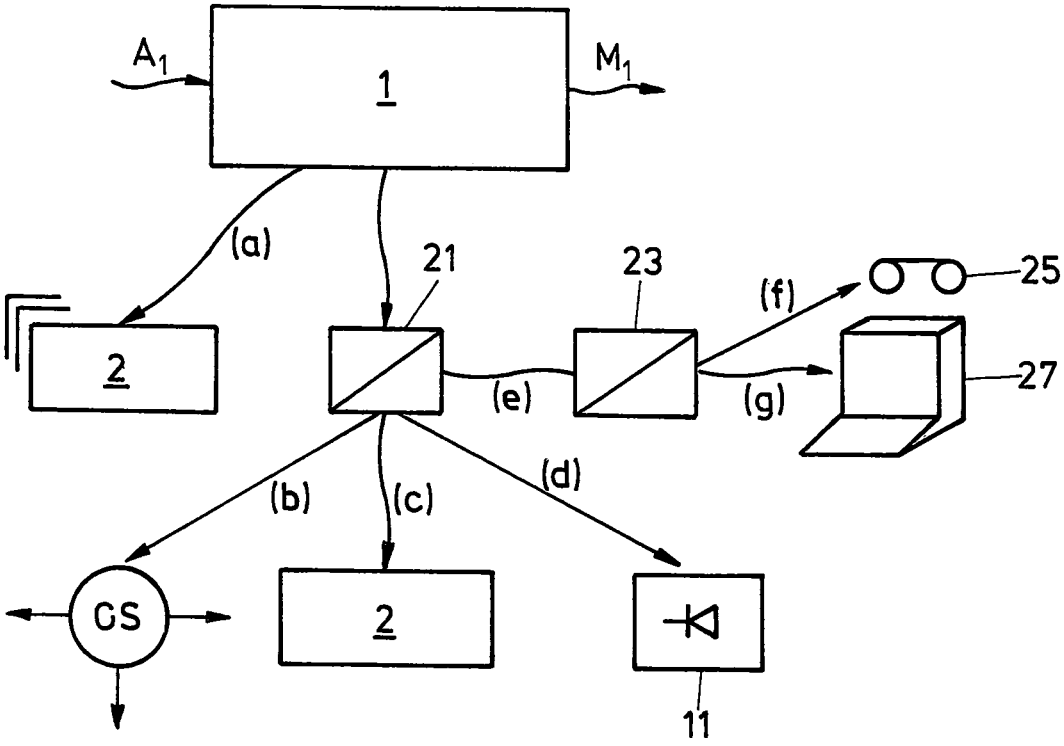
Figure 9:
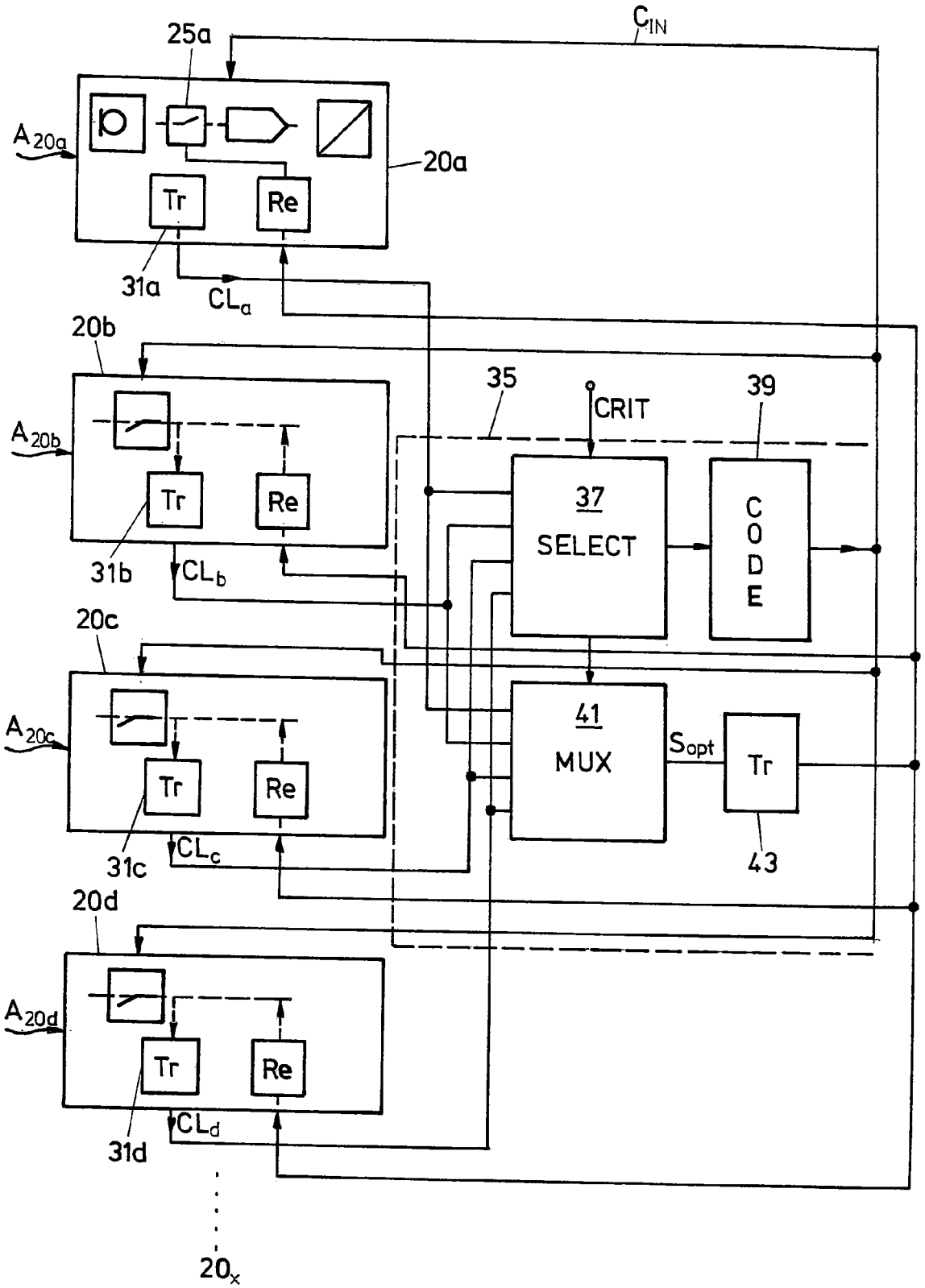
Figure 10:
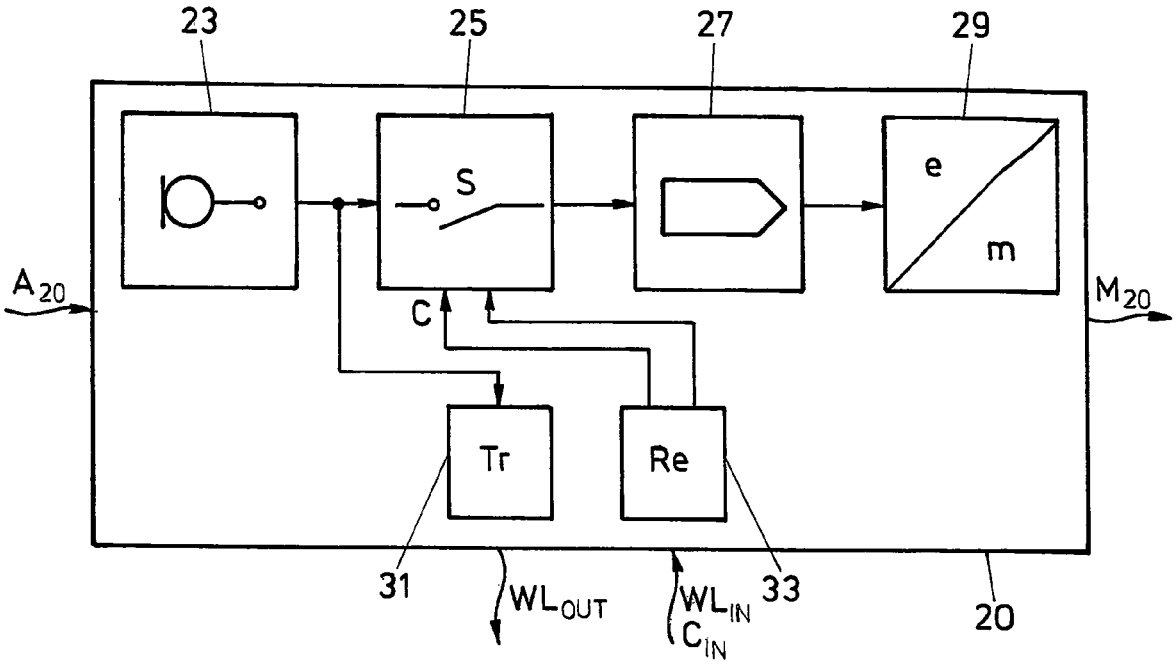
Figure 11:
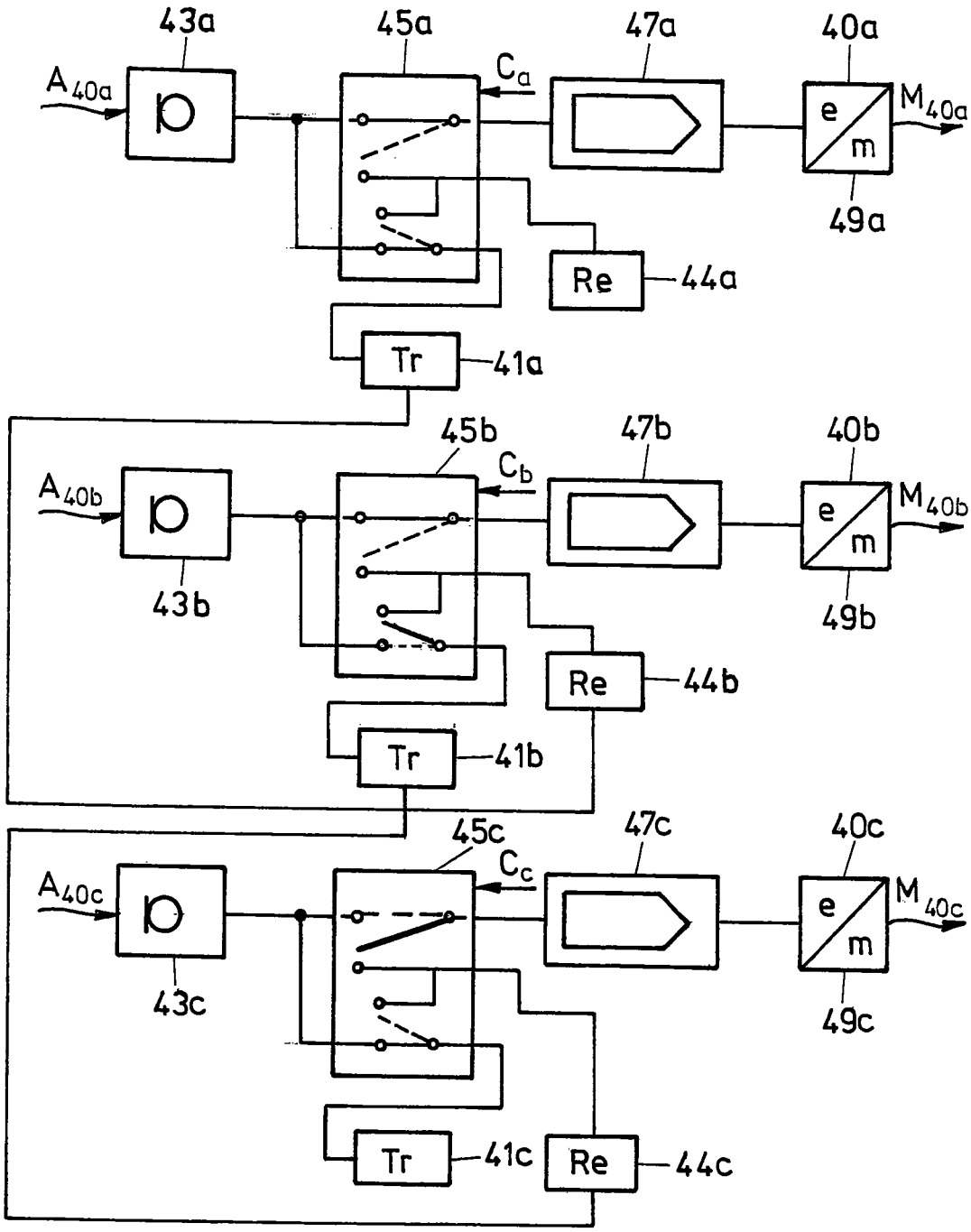
Figure 12:
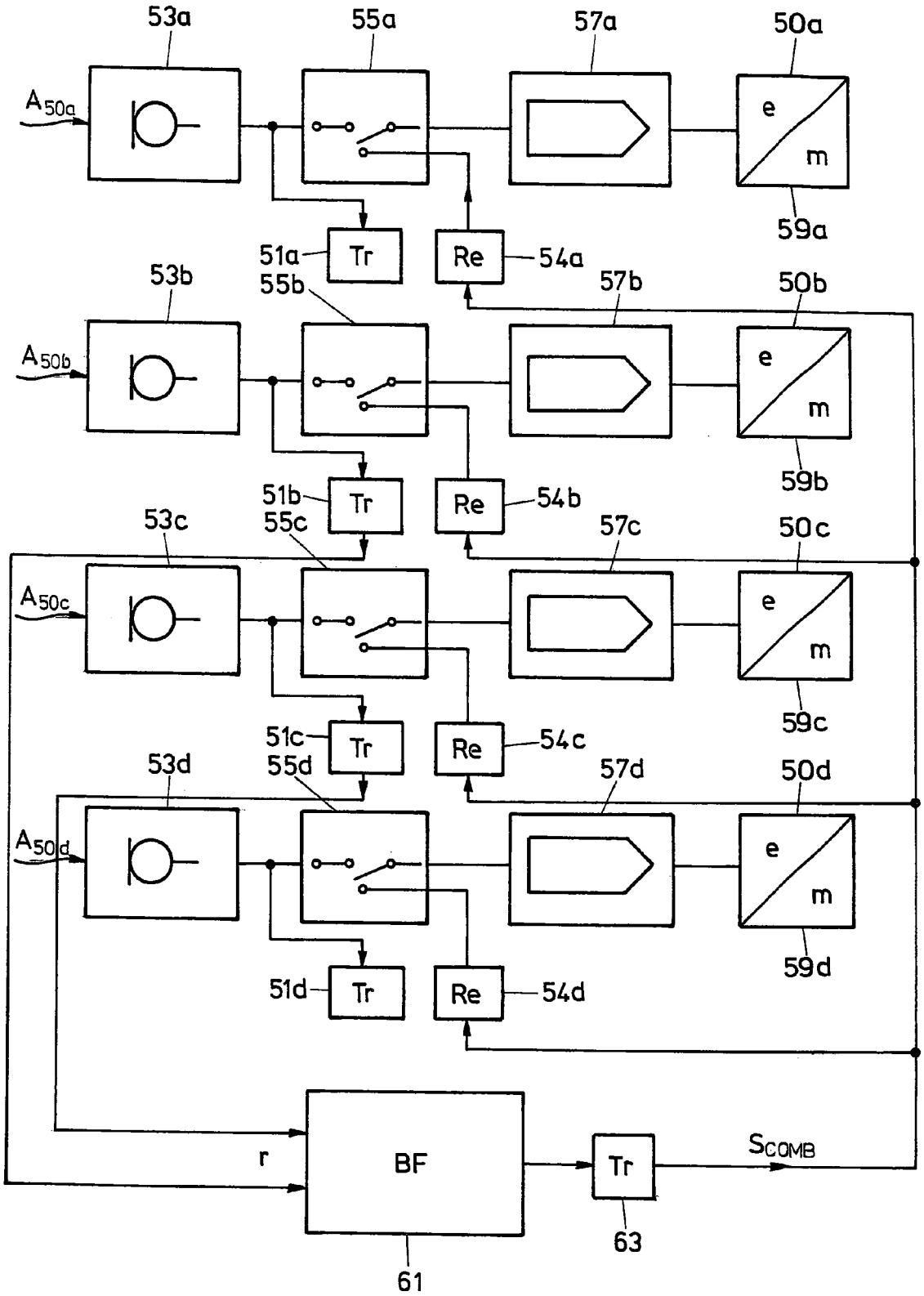

The present invention shall now be exemplified with the help of figures and by examples. The figures show:

FIG. 1 schematically and simplified by means of a functional block/signal flow diagram, the principle of a communication system according to the present invention including a hearing device according to the present invention;

FIG. 2 in a simplified schematical representation a further embodiment of the present invention;

FIG. 3 still in a simplified schematical representation a communication system with hearing device according to the present invention;

FIG. 4 in a schematic and simplified representation a further embodiment of the communication system according to the present invention including a hearing device according to the invention including a network;

FIG. 5 Still schematically and simplified by means of a functional block/signal flow diagram, a communication system according to the present invention for communication between at least two hearing devices;

FIG. 6 schematical and simplified a further at least two hearing devices communication system according to the present invention with direct wireless communication links;

FIG. 7 in a representation according to that of FIG. 6 a further embodiment of the communication system according to the present invention, whereat the communication is established by at least two wireless communication links via a signal booster unit;

FIG. 8 in a diagrammatic representation and as an example a complete communication system according to the present invention;

FIG. 9 by means of a simplified functional block/signal flow diagram, a further embodiment of a communication system according to the present invention whereat a master device is selected according to specific criteria;

FIG. 10 in a simplified functional block signal/signal flow diagrammatic form, a hearing device according to the present invention with transmission and receiver ability and as e.g. applied to the communication systems as exemplified in the FIGS. 9, 11 and 12;

FIG. 11 in a simplified functional block/signal flow diagram a communication system according to the present invention for device hopping communication between remote hearing devices;

FIG. 12 in a representation according to that of FIG. 11 a communication system according to the present invention whereat remotely perceived acoustical signals are commonly processed.

Figure 13:
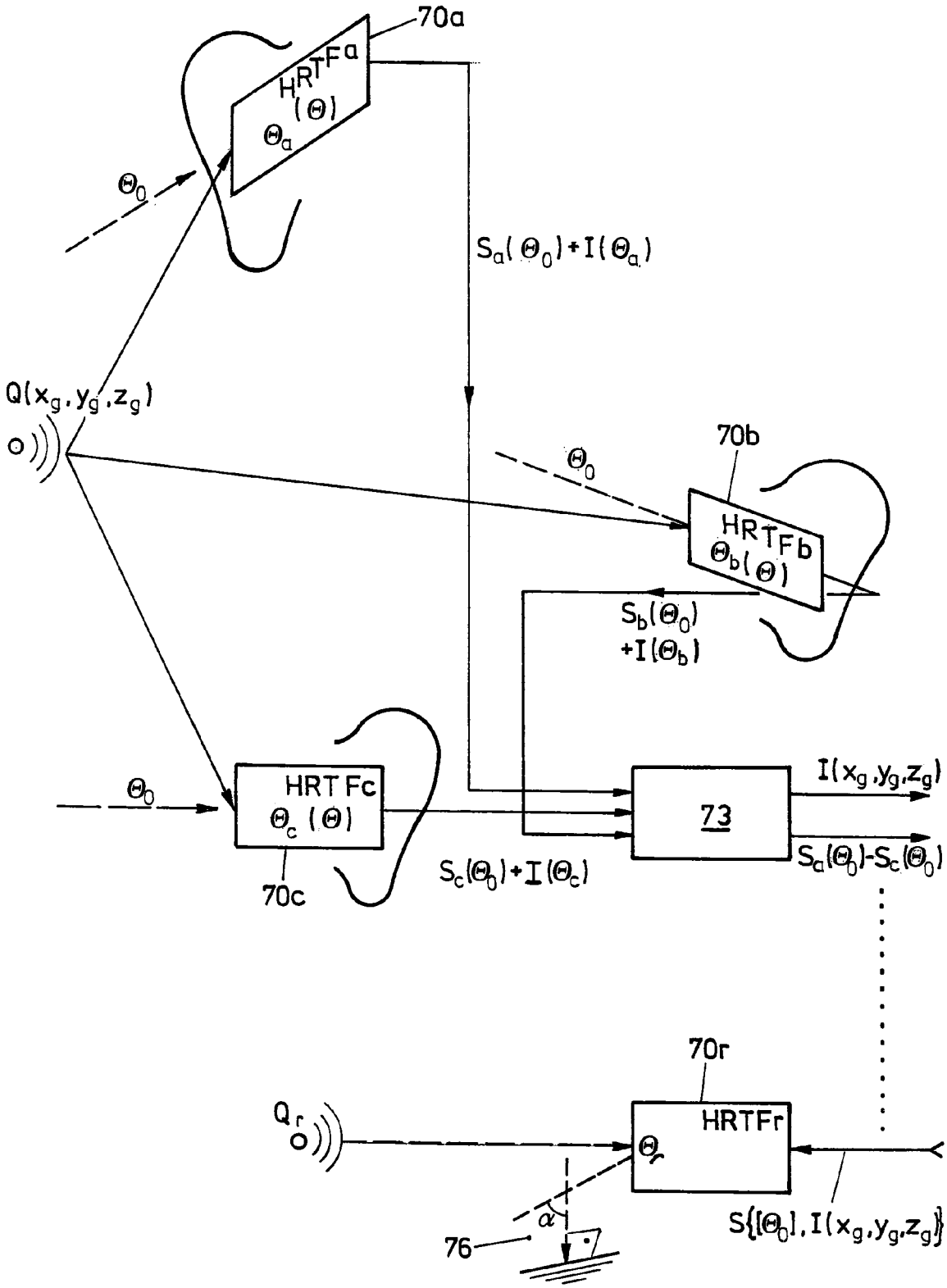

FIG. 13 simplified and in a schematical representation by means of a signal flow/functional block diagram a technique for the communication system according to the present invention to account for effects caused by different spatial location and orientation, as well as for individual effects of hearing devices of the system.

In FIG. 1 the communication system according to the present invention is shown in a first realization form and rather in a minimum configuration. The communication system comprises a hearing device 1.

The hearing device 1 comprises an acoustical-to-electrical converter unit 3. The electrical output of unit 3 is operationally connected, via a signal processing unit 5, to the input of an output electrical-to-mechanical converter unit 7.

Input to device 1 are surrounding acoustical signals $A_1$, output from device 1*a* mechanical signal $M_1$ as a stimulus to an individual's—1*a*—ear.

The hearing device 1 as an essential part of the communication system according to the present invention has a transmitter unit 9 whereat audio representing signals, which may be dependent from input acoustical signals $A_1$, are input. By transmitter unit 9, such audio representing signals are converted into wireless transmission signals WL. In opposition to the case where, for binaural hearing devices, a signal transmission, thereby also possibly in a wireless manner, is performed on short distance, i.e. from one ear of an individual to the other, according to the present invention the transmitter unit 9 generates a signal WL for longer range transmission e.g. for a range of at least 2 m, larger than necessary for reaching any target area at the individual 1*a*.

This is realized e.g. by larger transmission power, suitable modulation schemes, channel coding or broad band transmission techniques such as e.g. by ultra wide band (UWB)-type transmission.

Especially, if higher transmission power is used, care should be taken to install a proper directivity of signal transmission from transmitter unit 9, not to load the individual 1*a* with too high electromagnetic power.

By the wireless transmission signal WL at least a part of a communication link CL is established between the hearing device 1 and at least one listening device 11.

Via the communication link CL which is formed by or which comprises the wireless communication link WL, at least audio representing signals perceived at the one individual 1*a* with the help of the hearing device 1 are transmitted to at least one listening device 11 remote from the individual 1*a*. There the device 11 stimulates hearing of at least one further individual 11*a*.

The communication link CL consists, in minimum configuration, just of the wireless communication link WL established from the transmitter unit 9 of the hearing device 1 to a respective remote receiver unit 13 at the listening device 11, schematically shown in FIG. 2. Thereby the communication range is restricted to the wireless transmission range of the transmitter unit 9.

A scenario in which such "direct" wireless communication may be useful is schematically shown in FIG. 3.

In a conference room speech of a speaker individual 1*a* wearing the hearing device 1 or of an individual 1*a* which is located in a particularly good acoustical situation, is wirelessly linked to listening devices $\mathbf{11}_1$ to $\mathbf{11}_4$ of further individuals $\mathbf{11}_{a1}$ to $\mathbf{11}_{a4}$. Thereby the outstanding acoustical perception at the individual 1*a* is shared with the acoustically less favourably positioned individuals $\mathbf{11}_{a1}$ to $\mathbf{11}_{a4}$.

A situation in which the system as of FIG. 3 may also be useful is e.g. when a group of individuals $\mathbf{11}_{a1}$ to $\mathbf{11}_{a4}$ is led by a guide individual 1*a* through an exhibition.

Turning back to the representation of FIG. 1, the communication link WL may be just a part of a complex communication network. The communication link or network CL, comprising wireless link WL may include any known wireless or wire bound communication devices or structures, including e.g. wide area networks—WAN—local area network—LAN—, signal booster units, router units, signal processing units etc. Thereby the audio representing signal transmitted by the wireless link WL can be transmitted to one or more than one listening devices 11 situated anywhere up to worldwide.

This is schematically shown in FIG. 4. Here, the leading device 1 of an individual 1*a* communicates by the wireless link WL with the remote receiver unit 13 situated in a range easily bridgeable by the signal transmitted from transmitter unit 9 of hearing device 1. From the receiver unit 13 the audio representing signal as received is fed into a communication network CN, 14 which may incorporate any wireless and wire bound communication link to one or more than one ear, remote and/or far-remote listening device for respective individual's or groups of individuals.

Up to now the device finally receiving signals transmitted via WL has been described as a unit which receives audio representing signals exclusively over the communication link CL from one transmitting hearing device 1 with integrated transmitter 9. The receiving listening device 11 may thereby just be a loudspeaker unit 9 by which one or more than one individual 1*a* listens to the audio signals perceived by the individual wearing the hearing device 1 with transmitter unit 9.

In a further embodiment, as shown in FIG. 5 in a representation which is analogous to the representation of FIG. 1, the listening device 11 is realized by at least one further hearing device 2. As in the embodiments of FIGS. 1, 2, 3, 4 and also—as evident to the skilled artisan—in some embodiments to be described later, the electric audio representing signal which is transmitted by the transmitter unit 9 of hearing device 1 may be derived directly from the output of the input acoustical-to-electrical converter unit 3 or may be derived from a signal which has already been processed by one or more than one stages of the signal processing unit 5 or may be derived from the input to the output electrical-to-mechanical converter unit 7. E.g. if the individual 1*a* who wears the hearing device 1 is hearing impaired and hearing device 1 is a hearing aid device and thus provides for an individualized signal transfer function from the output of input converter unit 3 to input of output converter unit 7, it might be advisable to transmit by means of transmitter unit 9 substantially unprocessed output signals of the input converter unit 3. If individual 1*a* has normal hearing abilities and this hearing device 1 is substantially not individualized as a hearing aid device, it might be advisable to transmit by the transmitter unit 9 rather audio according to signals representing signals as applied to the input of the output converter unit 7.

According to FIG. 5 and as was addressed, the listening device 11 as of FIG. 1 is here realized by a second hearing device 2 which again may be one of the devices falling under the definition of "hearing devices" given above. By transmitter unit 9 of hearing device 1 the audio representing signal is transmitted via the wireless communication link WL finally to an input $I_2$ of the second hearing device 2. There this transmitted audio representing signal is generically fed to the output electrical-to-mechanical converter $\mathbf{7}_2$ of hearing device 2 and thus, an output mechanical signal $M_2$ is generated as a hearing stimulus signal to a second individual 2*a* remote from the individual 1*a* wearing hearing device 1. As hearing device 2 in its intrinsic mode of operation transmits acoustical input signals $A_2$ to the electrical-to-mechanical converter unit $\mathbf{7}_2$, it might be advisable to provide a control unit 15. By such control unit 15 the individual carrying the second hearing device 2 or another controlling instance may select whether such individual shall listen to the acoustical signals $A_2$ or shall be switched to a "slave" mode i.e. on the acoustical perception of hearing device 1 acting as a "master" hearing device. As will be explained later, in more sophisticated applications of the communication system according to the present invention, the control as to which hearing device shall act as a master device for one or more than one further hearing devices, is performed by a control unit 15 at the respective hearing devices manually or automatically e.g. by evaluating which of the hearing devices of the communication system at least momentarily experiences optimum or pre-selected acoustical conditions and selecting such a device at least momentarily as a master device.

Turning back to the generic representation of FIG. 5 it must be pointed out that here too the overall communication link CL may be realized just by the wireless communication link WL or, in a combination with such wireless link WL additional communication links which includes at least one wire bound and/or wireless communication link.

Please note the alternative operational connections to transmitter 9 and processing unit 52 shown in dashed lines.

According to FIG. 6 there is shown, even more schematically, master hearing device 1 communicating exclusively by the communication link WL with one or more than one slave hearing devices 2, $\mathbf{2}_1$. The communication link is established from the transmitter unit 9 of hearing device 1 to wireless receivers 17 in the further hearing devices 2, $\mathbf{2}_1$. The output signals of the receiver unit 17 respectively, is operationally connected to the input of respective output electrical-to-mechanical converter unit $\mathbf{7}_2$.

According to FIG. 7 the communication system between a master hearing device 1 and one or more than one slave hearing devices 2 is established by a communication link CL which consists exclusively of multiple wireless communication links. Thereby the overall communication link is established by the communication link WL from transmitter unit 9 of hearing device 1 to a signal booster unit 19 and from there, via a further wireless link WL' to the receiver unit 17 of one or more than one slave hearing devices 2, $\mathbf{2}_1$. Thereby it must be emphasized that unit 19 as shown in FIG. 7 may be, as shown in this figure, just a signal booster unit or may be a router unit, routing incoming signals to several output signals.

In FIG. 8 a more complex communication system according to the present invention is shown. Still, one of the hearing devices, hearing device 1, acts as master. It dispatches signals according to the acoustical surrounding $A_1$ to further individuals and their respective hearing devices 2, being switched or controlled in slave mode. Thereby they process, as input signals, audio representing signals, representing or depending on $A_1$. The hearing device 1 communicates by the integrated transmitter unit 9 wirelessly, and directly (a) with one or more than one hearing devices 2 worn by different remote individuals. Further or alternatively the hearing device 1 communicates by a wireless link from the transmitter unit 9 to a signal booster/router unit 21 directly, from which unit 21 the wirelessly received audio representing input signal is transmitted e.g. wire bound (b) to a wide or local area network and/or e.g. wirelessly (c) to one or more than one remote hearing devices 2 (c) and/or e.g. wire bound (d) to one or more than one general listening devices 11, and/or e.g. again wirelessly (e) with a further signal booster/router unit 23, which latter unit 23 distributes the signal still dependent on the acoustical signal $A_1$ as perceived by hearing device 1 to further units e.g. a registering unit 25 by wire bound link (f) and/or e.g. a displaying unit (27) as a laptop, by wireless link (g). Clearly additionally to the signals audio representing signals according video signals as of handicams may be transmitted to a video displaying unit as to units 27 in FIG. 8.

Up to now we have described several embodiments of the communication system according to the present invention which make use of a wireless link from one hearing device worn by one individual to a listening device thereby preferably at least one further hearing device which stimulates hearing of a second, remote individual. Thereby we have described this system rather as a master/slave-structure whereat acoustical signals which impinge on the master hearing device are transmitted to one or more than one further listening devices so that latter transmit the acoustical signal to the respective individuals which accord with the acoustical surrounding of the remote master device. In those embodiments where the listening devices are conceived as slave hearing devices we have discussed the hearing device specific control option as by units 15 of FIG. 5, with which, at the specific slave hearing devices, one may select whether the addressed hearing device shall transmit audio representing signals according to its proper acoustic surrounding or shall be switched in slave mode to transmit audio representing signals from the master hearing device.

Thereby the skilled artisan may realize a lot of variants of the communication system, of master/slave type, according to respective needs.

Whenever the communication system according to the present invention is established between at least two hearing devices, it opens a large number of additional possibilities to improve hearing of individuals wearing a hearing device which is part of the communication system.

This is generically done by selecting, in dependency of the momentarily prevailing acoustical situation, a respective device as a master device or by exploiting that more than one hearing device which are mutually distant may experience from different positions the same acoustical surrounding and that this may lead to improved overall perception which is re-fed to each single hearing device.

In FIG. 9 there is shown, by means of a simplified functional block/signal-flow diagram, one possible embodiment of a communication system according to the present invention whereat, principally, more than one hearing devices at respective individuals are exposed to about the same acoustical surrounding e.g. in a conference room at different locations. There is automatically evaluated at which of the hearing devices and thus at which of the individuals, momentarily there is optimum acoustical perception e.g. based on a signal-to-noise-ratio evaluation. The optimally exposed hearing device is momentarily selected as the master and the other hearing devices are switched to slave mode. As the acoustical surrounding changes e.g. changing speaker individual, automatically the respectively optimum hearing device is reselected as a master and accordingly the other hearing devices are switched to slave mode.

Clearly e.g. in a huge conference room with multiple individuals and hearing devices, groups of individuals with respective hearing devices may be formed and optimum device evaluation may be done separately for each group in analogy to the technique as will be exemplified with help of FIG. 9. Again it shall be shown to the skilled artisan, what huge amount of possibilities is opened by exploiting the communication system according to the present invention.

As a primary difference to the embodiments which have been explained up to now, according to FIG. 9, each of the hearing devices $\mathbf{20}_a \ldots \mathbf{20}_d \ldots \mathbf{20}_x$ is conceived as schematically shown at device 20 in FIG. 10.

A hearing device 20, as applied to a communication system as shown in FIG. 9, comprises according to FIG. 10 and in analogy to the hearing device 1 of FIG. 1, an input acoustical-to-electrical converter 23, operationally connected to a mode-control unit 25. The output of the mode-control unit 25 is operationally connected to signal processing unit 27 the output thereof being operationally connected to an output electrical-to-mechanical converter unit 29.

Further, the hearing device 20 has a transmitter unit 31. The transmitter unit 31 transmits wirelessly signals which are dependent from the acoustical input signals $A_{20}$ and therefore the input of the transmitter unit 31 is e.g. operationally connected to the output of the acoustical/electrical converter unit 23. Additionally the hearing device 20 has a receiver unit 33, wirelessly receiving at least audio representing signals. The output of receiver unit 33 is operationally connectable to output connecter unit 29, instead of the output signal dependent on the output of the acoustical-to-electrical converter 23.

The mode-control unit 25 controls, as schematically shown by switch S, whether the output signal of the acoustical/electrical converter 23 is, via processing unit 27, operationally connected to converter unit 29 or whether the output signal of receiver unit 33 is operationally connected, possibly via the signal processing unit 27, to said electrical-to-mechanical output converter unit 29.

The receiver 33 is adapted to receive, besides of wirelessly communicated audio representing signals $WL_{IN}$, control signals $C_{IN}$ which are separated by respective decoding and applied to control input C of the mode-control unit 25. By means of a signal applied to the control input C the operating mode of the hearing device is controlled either for transmission of impinging acoustical signals $A_{20}$ or for transmission of wirelessly received audio representing signals from receiver 33.

Thus the hearing device of FIG. 10 is adapted to be operative as a master hearing device or as a slave hearing device.

According to FIG. 9 each hearing device $\mathbf{20}_a$ to $\mathbf{20}_d$ communicates by a respective communication link $CL_a$ to $CL_d$, including the wireless communication link $WL_{OUT}$ according to FIG. 10, with a control unit 35 shown in FIG. 9 within dashed lines. For reasons of clearness in FIG. 9 also the wireless communication link $WL_{OUT}$ are shown in rigid straight lines. Via the transmitter units 31*a* to 31*d* audio representing signals according to signals $A_{20a}$ to $A_{20d}$ are simultaneously transmitted as they occur to a selection unit 37 of control unit 35. In selection unit 37 all the signals transmitted via the respective wireless transmitter units $\mathbf{31}_a$ to $\mathbf{31}_d$ are evaluated with respect to predetermined criteria. Such criteria may e.g. be or comprise signal-to-noise ratio. Such criteria are input to unit 37 via input CRIT. In a not too complex embodiment as exemplified in FIG. 9, the selection unit 37 selects one of the input signals as the optimum signal. Once such optimum signal is selected, the information as of which signal has been selected is entered to a coding unit 39 where a control signal $C_{IN}$ is generated. The output control signal $C_{IN}$ acts on each of the mode control units $\mathbf{25}_a$ to $\mathbf{25}_d$ of the respective hearing devices $\mathbf{20}_a$ to $\mathbf{20}_d$ and thereby switches all the units $\mathbf{25}_a$ to $\mathbf{25}_d$ to operationally connect, as shown in FIG. 10, a respective receiver unit 33 instead to the respective input acoustical-to-electrical converter unit, to the respective output electrical-to-mechanical converter unit 29, as via respective signal processing unit 27.

Thereby, as shown in FIG. 10, the control signal $C_{IN}$ is most preferably transmitted to the respective hearing devices via a control signal communication link which at least includes the wireless communication link to the respective receiver units 33 at the hearing devices 20. As was said all the hearing devices are thereby switched in fact into slave mode with the exception of the one of the hearing devices 20, the signal transmitted via the respective communication link CL having been selected as optimum by action of the selection unit 37.

Additionally the selection unit 37 controls a multiplexing unit 41 by which the selected audio representing signal is output as shown in FIG. 9 as $S_{opt}$.

Generically spoken this signal $S_{opt}$ is transmitted to the receiver units 33 especially of all those hearing devices 20, the signals output at the respective transmitter units 31 not having been selected as optimum. Thus of all the hearing devices according to FIG. 9 three receive the audio representing signal of the forth, which has been selected as optimally perceiving according to the criteria set in selection unit 37.

Clearly the transmission of $S_{opt}$ from control unit 35 to the respective hearing devices needs not be exclusively wirelessly, similarly to a communication over link CL which needs not be exclusively wireless by, too. Nevertheless, in the representation according to FIG. 9, the control unit 35 has a transmitter unit 43 which converts $S_{opt}$ in a wirelessly transmitted output signal, transmitted to all or at least to three of four receiver units 33 of the hearing devices $\mathbf{20}_a$ to $\mathbf{20}_d$.

So as to establish at the selection unit 37 as of FIG. 9 which of the received signals originates from which of the hearing devices, each hearing device may e.g. send together with the audio representing signal an identification code.

By such a communication system all participating hearing devices are sending wirelessly audio representing signals according to their acoustic signals received to the control unit 35. In the control unit 35 the received signals are estimated according to predetermined criteria.

The best signal under the constraint of the criteria as preset in selection unit 37, is evaluated and therewith one transmitting hearing device. That hearing device may be maintained in that operating mode whereat the input acoustical-to-electrical converter unit is operationally connected to the output electrical-to-mechanical converter. All the other hearing devices are switched to the mode wherein the respective output electrical-to-mechanical converter is operationally connected to the output of the receiver unit which receives, wirelessly, signals according to the acoustical signal perceived by the addressed one hearing device.

It has to be noted that according to FIG. 9 the control unit 35 has been shown as a unit separate from the hearing devices 20. Thereby this shall not be limiting in that such control unit 35 may be integrated into one or more than one of the hearing devices participating in the communication system network.

Generically it must further be emphasized that whenever the hearing devices are conceived to comprise a transmitter unit, as of unit 31 of FIG. 10, and a receiver unit, as of unit 33 of FIG. 10, and further are controllable as by the control unit 25 in to "intrinsie" perception mode as well as into "slave" mode, a huge number of different communication systems may be realized, as becomes clear to the skilled artisan reading the present teaching.

E.g. with the help of such hearing devices with transmission and reception ability, a communication system which makes use of a "device hopping" architecture may be realized as shown in FIG. 11.

The hearing devices $\mathbf{40}_a$ to $\mathbf{40}_d$ according to FIG. 11 comprise each, as was already discussed, an input acoustical-to-electrical converter unit $\mathbf{43}_a$ to $\mathbf{43}_c$, operationally connected to respective processing units $\mathbf{47}_a$ to $\mathbf{47}_c$, latter to respective output electrical-to-mechanical converter units $\mathbf{49}_a$ to $\mathbf{49}_c$.

As schematically shown there is further, inter-connected between the outputs of the input converter unit 43 and the inputs of the signal processing unit 47, respectively, a mode-control unit $\mathbf{45}_a$ to $\mathbf{45}_c$ which controllably inter-connects, for different operating modes, on one hand the respective transmitter unit $\mathbf{41}_a$ to $\mathbf{41}_c$, receiver units $\mathbf{43}_a$ to $\mathbf{43}_c$ with the respective signal processing unit $\mathbf{47}_a$ to $\mathbf{47}_e$ and, on the other hand, the respective receiver unit $\mathbf{43}_a$ to $\mathbf{43}_c$ with the respective transmitter unit $\mathbf{41}_a$ to $\mathbf{41}_c$ with each others as will be explained. The mode control units $\mathbf{45}_a$ to $\mathbf{45}_e$ are controlled as schematically shown at control inputs $C_a$ to $C_c$ which may be done e.g. from a central control (not shown) unit, governing operating modes of the hearing devices in the communication system. Such control is most preferably performed in wireless communication.

As exemplified in FIG. 11 a first hearing device $\mathbf{40}_a$ worn by a first individual is operated in the following manner:

The incoming acoustical signal $A_{40a}$ is, after acoustical to electrical conversion by control unit $\mathbf{45}_a$, switched in operational connection to the output electrical-to-mechanical converter unit $\mathbf{49}_a$ via signal processing unit $\mathbf{47}_a$.

The perceived acoustical signal $A_{40a}$ after conversion is further operationally connected by appropriately controlled unit $\mathbf{45}_e$ as shown, to the transmitter $\mathbf{41}_a$ wherefrom it is wirelessly transmitted.

The receiver $\mathbf{44}_a$ is switched into disabled mode by control unit $\mathbf{45}_a$.

The wirelessly transmitted output signal of transmitter $\mathbf{41}_a$ is received at the second hearing device $\mathbf{40}_b$. This second hearing device is operated as follows:

The acoustical input signal $A_{40b}$ is, after conversion and signal processing, operationally connected to the output electrical-to-mechanical converter unit $\mathbf{49}_b$.

The output of receiver $\mathbf{43}_b$ is, operationally connected to the input of transmitter unit $\mathbf{41}_b$ which latter is disconnected from the output of the acoustical/electrical converter unit $\mathbf{43}_b$.

The signal transmitted by the transmitter $\mathbf{41}_a$ of first hearing device $\mathbf{40}_a$ is received at the receiver $\mathbf{44}_b$ of the second hearing device $\mathbf{40}_b$ and from the output of this unit it is operationally connected to the input of the transmitter unit $\mathbf{41}_b$ from which it is further transmitted wirelessly. Thus the second hearing device operates in intrinsie mode i.e. processes its own acoustical surrounding signal but additionally acts as transit unit boosting wirelessly transmitted signals from the first hearing device towards further devices.

The third hearing device $\mathbf{40}_c$ is operated as follows:

The output of the input acoustical-to-electrical converter unit $\mathbf{43}_c$ is disabled from operational connection to the output electrical-to-mechanical converter unit $\mathbf{49}_c$. Instead, the output of the receiver $\mathbf{44}_c$ is operationally connected via control unit $\mathbf{45}_c$, processing $\mathbf{47}_c$ to the input of the electrical-to-mechanical converter unit $\mathbf{49}_c$.

Thus the third hearing device $\mathbf{40}_c$ operates in slave mode with hearing device $\mathbf{40}_a$ as a master, the second hearing device $\mathbf{40}_b$ acting as a transit or booster station for the signal transmission.

In a further embodiment of the communication system according to the present invention the hearing devices of two or even more than two individuals are commonly exploited to result in an audio representing signal which is improved with respect such signals at each of the separately considered hearing devices.

One of such embodiments is schematically shown in FIG. 12. According to this embodiment and as an example, four hearing devices $\mathbf{50}_a$ to $\mathbf{50}_d$ are linked to form a communication system according to the present invention. Each of the four exemplified hearing devices $\mathbf{50}_a$ to $\mathbf{50}_d$ comprises respectively an input acoustical-to-electrical converter $\mathbf{53}_a$ to $\mathbf{53}_d$ the output thereof operationally acting via a respective mode control unit $\mathbf{55}_a$ to $\mathbf{55}_d$ on a respective signal processing unit $\mathbf{57}_a$ to $\mathbf{57}_d$. The outputs of the signal processing units respectively are operationally connected to the output electrical/mechanical converter units $\mathbf{59}_a$ to $\mathbf{59}_d$.

Further, each of the hearing devices has a respective transmitter unit $\mathbf{51}_a$ to $\mathbf{51}_d$, to which signals which accord with a respectively input acoustical signal $A_{50a}$ to $A_{50d}$ are fed. The transmitter units $\mathbf{51}_a$ to $\mathbf{51}_d$ wirelessly transmit at least audio representing signals.

The hearing devices $\mathbf{50}_a$ to $\mathbf{50}_d$ further comprise receiver units $\mathbf{54}_a$ to $\mathbf{54}_d$ at least for audio representing signals which are wirelessly transmitted. The output of units $\mathbf{54}_a$ to $\mathbf{54}_d$ are respectively operationally connected to respective inputs of the signal processing units $\mathbf{57}_a$ to $\mathbf{57}_d$.

The respective control units $\mathbf{55}_a$ to $\mathbf{55}_d$ control in this specific embodiment whether, at a hearing device considered, audio representing signals according to the acoustical surrounding shall be processed or whether audio representing signals as received by the receiver unit shall be processed.

As further shown all the hearing devices $\mathbf{50}_a$ to $\mathbf{50}_d$ are operated in that mode wherein the outputs of the respective receivers $\mathbf{54}_a$ to $\mathbf{54}_d$ are operationally connected to the inputs of the respective signal processing units and thus to the outputs of the respective electrical-to-mechanical converter units $\mathbf{59}_a$ to $\mathbf{59}_d$.

All or at least two of the wirelessly transmitted signals transmitted by the transmitters $\mathbf{51}_a$ to $\mathbf{51}_d$ of the hearing devices are received—r— at a computing unit 61, wherein generically spoken, the input signals are commonly computed to result in a combined audio representing signal $S_{COMB}$. The computing unit 61 may thereby be a beam forming unit BF wherein from the input audio representing signals a single output audio representing signal is generated.

By the computing unit 61 there is generated a result audio representing signal which is improved compared with any such signal generated at respective single hearing devices, due to the fact that by the mutually distant input acoustical-to-electrical converter units at separate individuals, improved beam forming becomes possible.

In computing unit 61 all input signals may additionally be evaluated according to specific criteria e.g. signal-to-noise ratio.

The output of the computing unit 61 is operationally connected to a transmitter unit 63 by which the result signal $S_{COMB}$ is transmitted to all the receiver units $\mathbf{54}_a$ or $\mathbf{54}_d$ of the hearing devices. All the hearing devices according to example of FIG. 12 are fed with the result audio representing signal. Thereby FIG. 12 shows one possible embodiment out of a number of such embodiments where the acoustical perception ability of two or more than two hearing devices which are worn by different individuals are combined to result in an optimized result signal to be retransmitted to a predetermined number or to all of the hearing devices which participate in the communication system according to the present invention.

It has to be noted that the specific location of computing unit 61 and transmitter 63 according to FIG. 12 remote from any hearing device is only one possible realization form. Such computing unit may be incorporated in one or more than one of the hearing devices. The transmitter unit 63 may thus be one of the transmitter units which are already integrated in the hearing devices.

It further has to be pointed out that the control of the mode-control units 25, 45 and 55 as have been exemplified schematically under FIGS. 10, 11 and 12 may be performed e.g. from a central control unit or from a leading hearing device or decentralised by each participating hearing device; such control may be performed as a function of momentary reception characteristics of the involved hearing devices.

Hearing devices may also use a combination of acoustical and/or electrical signals or other information to determine their relative position to one another, e.g. by measuring time delays of signal reception, ect., in order to e.g. form appropriate beam former or select an appropriate input signal. With e.g. the help of this location information, appropriate externalisation (i.e. application of correct head related transfer function, HRTF) of the received signal can be performed to achieve a natural sound quality despite the audio signal being transmitted electrically and not only acoustically.

Therefore, in FIG. 13 there is shown, in a most generalized form, a technique to account for different spatial location and orientation as well as for individual effects of hearing devices operating within the communication system according to the present invention.

According to FIG. 13 as an example three hearing devices $\mathbf{70}_a$ to $\mathbf{70}_c$ are operating in a communication system as was described in each embodiment according to the FIGS. 1 to 12. Considering the case where all the three hearing devices $\mathbf{70}_a$ to $\mathbf{70}_c$ are exposed to an acoustical source Q they are under real life conditions, exposed to such source Q under different spatial angles. This dependent from the momentary position of the respective individual's head carrying the respective hearing devices. Each of the hearing devices $\mathbf{70}_a$ to $\mathbf{70}_c$ experiences the source Q under a specific direction of arrival, which is, in FIG. 13, addressed generically by the angle $\theta_a$ to $\theta_c$. Each of these directions of arrival are mutually independent or with some degree of dependency, if e.g. the source Q itself is moving. The acoustical signals perceived by the hearing device $\mathbf{70}_a$ to $\mathbf{70}_c$ are weighted by the individual "head related transfer functions" $HRTF_a(\theta_a)$ to $HRTF_c(\theta_c)$, which are dependent from the direction of arrival $\theta_a$ to $\theta_c$ respectively. Techniques are known as e.g. from the WO 00/68703 of the same applicant as the present invention, to determine, at a hearing device considered, the direction of arrival of acoustical signals and thus of $\theta_a$ to $\theta_c$. Thus the skilled artisan knows how to determine at the respective hearing devices of FIG. 13 the direction of arrival $\theta$. Once this direction of arrival $\theta$ at the respective hearing devices incorporated in the communication system of the present invention is known and the individual head related transfer function HRTF ($\theta$) as well and is e.g. stored in each of the individual's hearing devices $\mathbf{70}_a$ to $\mathbf{70}_c$, the value of such head related transfer function at each hearing device and at each individually experienced direction of arrival $\theta_a$ to $\theta_c$ is known as well. Knowing this amplification function which is dependent from direction of arrival namely the head related transfer function HRTF ($\theta$) at each of the hearing devices, the perceived acoustical signal is de-individualized in that at each hearing device, as an example, there is calculated e.g. by the signal processing unit incorporated in such device an audio representing signal which accords with an acoustical signal which would be perceived if the source Q was located at a predetermined direction of arrival $\theta_o$, $\theta_o$ may e.g. accord with a direction straight in front of the respective individual.

By doing so there is generated at each of the addressed hearing devices an audio representing signal which represents an acoustical signal, in fact a virtual signal as it would be generated if the source Q was located at the addressed direction of arrival $\theta_o$. Such virtual direction of arrival is shown in FIG. 13 at each of the hearing devises in dash lines.

As further schematically shown in FIG. 13 the audio representing signals which are wirelessly transmitted are de-individualized with respect to amplification as shown by $S_a(\theta_o)$ to $S_c(\theta_o)$. As further shown in FIG. 13 the signals are transmitted to a generic unit 73 representing a generical further treatment of these signals $S(\theta_o)$ as applied according to the present invention.

Thus in one embodiment according to the present invention audio representing signals which are wirelessly transmitted from respective hearing devices and which depend from acoustical signals impinging upon the addressed hearing device may be individualized by taking into account, at each of the hearing devices, the individual's HRTF functions.

In a further embodiment which may build upon wirelessly transmitted signals which are de-individualized as was just explained, it is targeted to provide for a target listener an acoustical perception as if, virtually, the acoustic source Q was present to such listener at a predetermined spatial location. To do so and as an example, additionally to the de-individualized signals $S(\theta_o)$ the specific direction of arrival information $I(\theta_a)$ to $I(\theta_c)$ is transmitted from the respective hearing devices to further exploitation as schematically shown by unit 73. This is shown in FIG. 13 by the $+I(\theta)$ notation.

By exploiting information about the real respective direction of arrival $\theta_a$ to $\theta_c$ e.g. processing such information in a triangulation kind process e.g. at unit 73, the spatial location of signal source Q is determined within the space acoustically "monitored" by the hearing devices $\mathbf{70}_a$ to $\mathbf{70}_c$.

By monitoring the relative position of the hearing devices $\mathbf{70}_a$ to $\mathbf{70}_c$ which may be done as was exemplified by exploiting information about simultaneously experienced directions of arrival, the spatial location of source Q e.g. with coordinate $x_q$, $y_q$, $z_q$ may be calculated. This is done e.g. at unit 73. Thus at the output of unit 73 information is available about location of source Q, addressed in FIG. 13 by $I(x_q, y_q, z_q)$ and the individualized signals $S_a(\theta_o)$ to $S_c(\theta_o)$.

Irrespective of what signal processing is performed upon the audio representing signals which have been wirelessly transmitted according to $S_a(\theta_o)$ to $S_c(\theta_o)$, by exploiting the spatial location information $I(x_q, y_q, z_q)$ a listener with hearing device $70_r$ to which audio representing signals are transmitted which depend from the audio representing signals $S_a$ to $S_c$ may experience a virtual source $Q_v$ at a predetermined spatial position similar to one of the hearing device $70_a$ to $70_c$ which are physically exposed to the acoustic signals of real source Q.

Re-individualization of the audio representing signals sent to the listening device $70_r$ as a receiver device may be done at this device by weighting such signals by the head related transfer function $HRTF_r$ of the individual wearing the device $70_r$ e.g. by additionally monitoring the spatial angle of device $70_r$ with respect to virtual source $Q_v$ or absolutely in space, as shown at 76. This may e.g. be done by monitoring head movement of the individual carrying the receiver device $70_r$.

The skilled artisan being taught by the example as of FIG. 13 and its description to exploit directional information for virtual source generation at a receiver device becomes aware of ample possibilities to realize such objects.

The invention claimed is:

1. Communication system comprising a hearing device worn at one or at both ears of one individual and improving hearing ability of an individual and comprising:

an input acoustical-to-electrical converter unit with a first input and a first output, to convert acoustical signals from the surrounding of the individual impinging on said first input into electric signals representing said acoustical signals at said first output;

a signal processing unit with a second input and a second output, said second input being operationally connected to said first output, said signal processing unit generating electrical signals at said second output, representing said acoustical signals;

an output electrical-to-mechanical converter unit with a third input and a third output, said third input being operationally connected to said second output, said output electrical-to-mechanical converter generating at said third output mechanical signals representing said acoustical signals;

a wireless transmitter with a fourth input and a fourth output, said fourth input being operationally connected to said first output, said wireless transmitter transmitting at said fourth output wirelessly signals representing said acoustical signals;

a remote wireless receiver, remote from said individual, with a fifth input and with a fifth output, said fifth input being wirelessly connected to said fourth output, said remote wireless receiver generating electrical signals at said fifth output representing said acoustical signals;

a remote electrical-to-mechanical converter unit, remote from said individual, with a sixth input and a sixth output, said sixth input being operationally connected to said fifth output, said remote electrical-to-mechanical converter unit generating mechanical signals at said sixth output, representing said acoustical signals, so that a second individual at a second location remote from a first location of said one individual may perceive said acoustical signals independent from a difference of said locations.

2. The system of claim 1, wherein said remote wireless receiver has one of a wired and of a wireless fifth output.

3. The system of claim 1, wherein the wireless communication link between said fourth output and said fifth input is a part of a communication network.

4. The system of claim 1, wherein said remote electrical-to-mechanical converter is built into a further hearing device worn at one or at both ears of said second individual, said further hearing device comprising a further input acoustical-to-electrical converter unit and a further output electrical-to-mechanical converter unit.

5. The system of claim 4 wherein said remote electrical-to-mechanical converter is said further output electrical-to-mechanical converter unit.

6. The system of claim 5, wherein said further hearing device comprises a further wireless receiver, with a seventh input and a seventh output, said seventh input being operationally connected to said fifth output, said seventh output being operationally connected to an input of said further output electrical-to-mechanical converter unit.

7. The system of claim 1, wherein said remote wireless receiver is built into said further hearing device.

8. The system of claim 3, wherein said wireless communication link is part of a communication network comprising at least one of a wide area communication system—WAN—, a local area communication system—LAN—, a signal booster unit, a router unit, and a signal processing unit.

9. The system of claim 1, wherein the wireless communication link between said fourth output and said fifth input is of frequency modulation—FM—type or of ultra wide band—UWB—type.

10. The system of claim 1, wherein said one hearing device worn at one or at both ears of said one individual has a wireless receiver with an output operationally connected to the input of said electrical-to-mechanical converter unit of said one hearing device, said further hearing device to be worn at one or at both ears of a second individual has a wireless transmitter connected to the output of said further input acoustical-to-electrical converter unit of said further hearing device, said wireless transmitter of said further hearing device and said wireless receiver of said one hearing device enabling a communication link to be established at least for acoustical signals representing signals from said transmitter of said further hearing device to said receiver of said one hearing device.

11. The system of claim 10, wherein said one and said further hearing devices comprise a mode control unit, said mode control unit controlling at said respective hearing devices operational connections of the input of said respective wireless transmitter to the output of said respective acoustical-to-electrical converter, the output of said respective wireless receiver to the input of said respective output electrical-to-mechanical converter, the output of said respective wireless receiver to the input of said respective wireless transmitter.

12. The system of claim 11 comprising a selection unit selecting direction of transmitting wirelessly signals representing acoustical signals impinging on an acoustical-to-electrical converter of one of said further hearing devices.

13. The system of claim 12 comprising more than two of said one and further hearing devices.

14. The system of claim 12, wherein said selection unit comprises a computing unit, the outputs of said acoustical-to-electrical converter units of said one and further hearing devices respectively are operationally connected to the inputs of said computing unit, said computing unit generating, in dependency from the signals input to said inputs of said computing unit, a selection control signal to said selection unit and a mode control signal to at least a part of said the mode control units at said one and further hearing devices.

15. The system of claim 14, wherein said computing unit performs generating said selection control signal and mode control signal dynamically.

16. The system of claim 1, wherein said hearing device is a hearing aid device.

17. The system of claim 5, wherein said further hearing device is a hearing aid device.

* * * * *